US006544107B2

(12) United States Patent
Misra et al.

(10) Patent No.: US 6,544,107 B2
(45) Date of Patent: Apr. 8, 2003

(54) COMPOSITE POLISHING PADS FOR CHEMICAL-MECHANICAL POLISHING

(75) Inventors: Sudhanshu Misra, Orlando, FL (US); Pradip K. Roy, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 58 days.

(21) Appl. No.: 09/785,756

(22) Filed: Feb. 16, 2001

(65) Prior Publication Data

US 2002/0115385 A1 Aug. 22, 2002

(51) Int. Cl.[7] ..... B24B 1/00

(52) U.S. Cl. ..... 451/41; 451/528; 451/289; 451/529

(58) Field of Search ..... 451/529–537, 451/921, 41, 287–290

(56) References Cited

U.S. PATENT DOCUMENTS 5,197,999 A 3/1993 Thomas
5,212,910 A 5/1993 Breivogel et al.
5,257,478 A 11/1993 Hyde et al.
5,609,517 A 3/1997 Lofaro
5,769,699 A * 6/1998 Yu ..... 451/528
5,899,745 A * 5/1999 Kim et al. ..... 438/692
5,931,719 A * 8/1999 Nagahara et al. ..... 451/41
5,944,583 A 8/1999 Cruz et al.
5,993,293 A 11/1999 Cesna et al.
6,089,966 A 7/2000 Arai et al.
6,093,085 A * 7/2000 Yellitz et al. ..... 451/41

* cited by examiner

*Primary Examiner*—George Nguyen

(57) ABSTRACT

The present invention provides a composite polishing pad, comprising. In an advantageous embodiment, the composite polishing pad includes a polishing pad member comprising a material having a predetermined hardness and an annular support member underlying a periphery of the polishing pad member, the annular support member having a hardness less than the predetermined hardness of the polishing pad member.

18 Claims, 5 Drawing Sheets

Fig. 2A
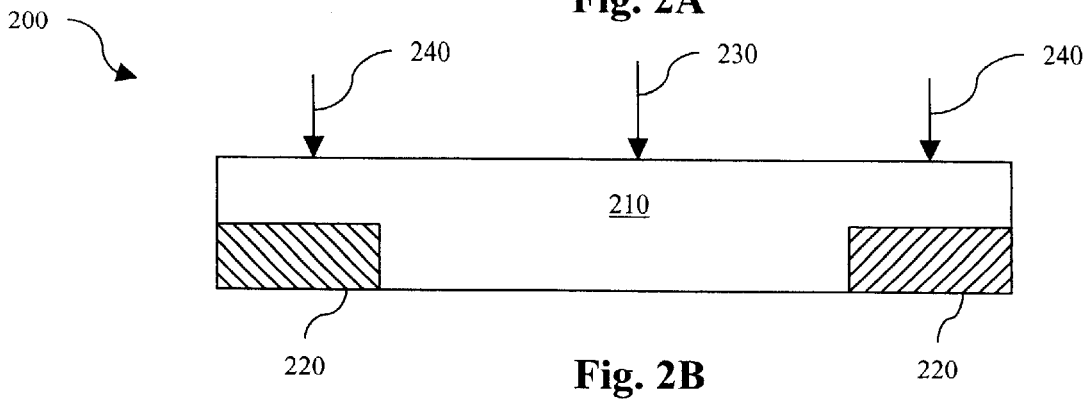
Fig. 2B
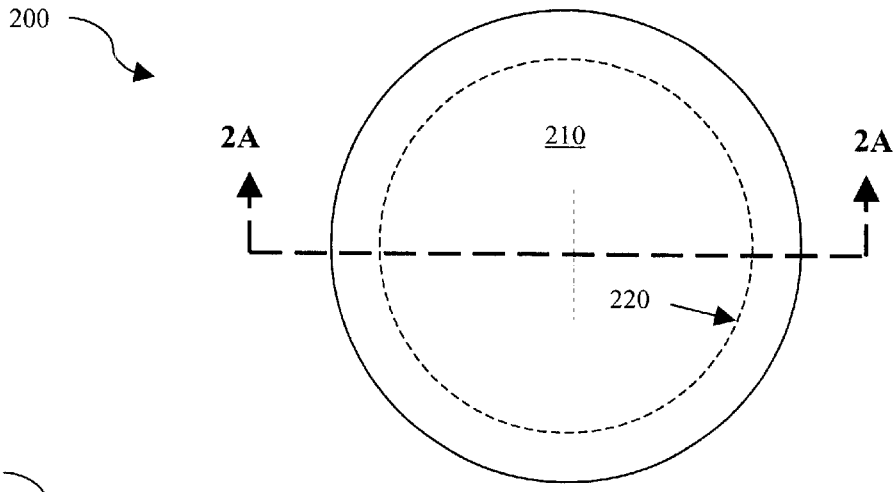
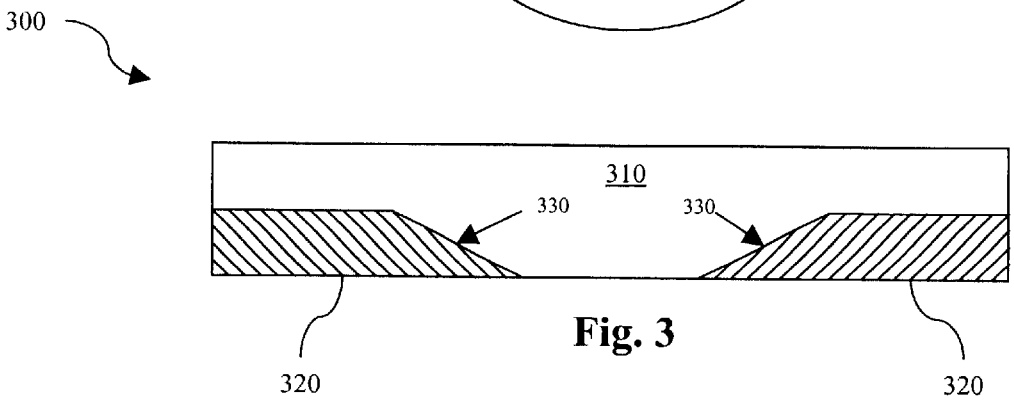
Fig. 3
Fig. 4
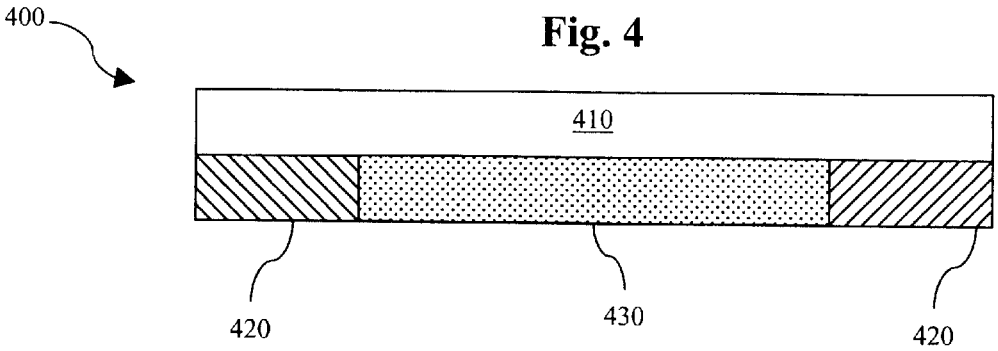

COMPOSITE POLISHING PADS FOR CHEMICAL-MECHANICAL POLISHING

TECHNICAL FIELD OF THE INVENTION

The present invention is directed, in general, to a semiconductor wafer polishing pad and, more specifically, to a composite polishing pad for use in a chemical-mechanical polishing (CMP) process.

BACKGROUND OF THE INVENTION

In the fabrication of semiconductor components, the various devices are formed in layers upon an underlying substrate, such as silicon. In such semiconductor components, it is desirable that all layers, including insulating layers, have a smooth surface topography, since it is difficult to lithographically image and pattern layers applied to rough surfaces.

Conventional chemical/mechanical polishing (CMP) has been developed for providing smooth semiconductor topographies. Typically, a given semiconductor wafer may be planarized several times, such as upon completion of each metal layer.

The CMP process involves using a wafer carrier to hold, and optionally rotate, a thin, reasonably flat, semiconductor wafer against a rotating polishing pad. The wafer may be repositioned radially within a set range as the polishing pad is rotated across the surface of the wafer. The polishing surface of the polishing pad, which conventionally includes a polyurethane material affixed to a platen, is wetted by a chemical slurry, under controlled chemical, pressure, and temperature conditions. The chemical slurry contains selected chemicals which etch or oxidize selected surfaces of the wafer during the CMP process in preparation for their removal.

Additionally, the slurry contains a polishing agent, such as alumina ceria or silica, that is used as the abrasive material for the mechanical removal of the semiconductor material. The combination of chemical and mechanical removal of material during the polishing process is used to achieve overall planarity of the polished surface of the semiconductor wafer. To this end, the uniform removal of material has become increasingly important in today's submicron technologies where the layers between device and metal levels are constantly getting thinner.

Unfortunately, in commercial wafer polishing operations, despite precautions to the contrary, the rate of material removal is not uniform across the entire wafer surface. Specifically, a wafer that does not evidence good planarity of the individual dies located therein is said to evidence poor "within-die" control. However, even if the wafer evidences good within-die control, if that wafer does not evidence uniform planarity from die to die, across its entire surface, it is said to have poor "within-wafer" control. For example, even though the wafer carrier is made relatively flat and rigid so as to apply a uniform downward pressure across the backside of the wafer, the wafer still has a tendency to distort during the polishing process as it is pressed onto the polishing pad. This often results in the outer annular edge region of the wafer showing evidence of decreased material removal compared to the inner portions of the wafer. This, in turn, introduces wafer non-uniformities, decreasing within-wafer uniformity.

Due to differences in polishing characteristics at the edge of the wafer compared to the center regions of the wafer, there is an "edge exclusion" for uniformity achievable across the wafer. Typically, the uniformity for planarization within a die and across the wafer are achievable within acceptable limits extendable to within 6–10 mm for the outer edge of a typical eight inch wafer. This edge exclusion is a result of the wafer carrier and polishing pad dynamic interaction that is directly related to the polishing process parameters (such as applied downforce, relative platen speed, etc.) during CMP.

Due to this reason, the edge region of the wafer often reaches the point where devices located along the edge region are less desirable, or in many cases unuseable. There is an increasing emphasis among manufacturers of semiconductor devices that the lost use of the edge area ("edge exclusion") be reduced. Due to the high price of semiconductor wafers, such reduction has significant economic effects. As semiconductor devices become larger, edge exclusion will continue to play a role in reducing the number of devices that can be obtained from a semiconductor wafer.

Perhaps the primary factor preventing uniform polishing from being obtained at the outer edge of the wafer is considered to be the polishing pad. Commercially available polishing pads are available in varying degrees of hardness or "compressibility." Softer pads having a higher compression rate more easily conform to the different features on the wafer and tend to achieve good within-wafer planarity. However, because of their tendency to distort to conform to the varying features, softer pads fail to provide good local planarity, resulting in poor within-die control. On the other hand, harder pads having a lesser compression rate, conform less to the various features on the wafer surface and tend to achieve good within-die control. However, the good within-die planarity obtained is usually at the expense of uniform planarity across the entire wafer, primarily at the outer edge of the wafer, resulting in poor within-wafer control.

In the prior art, composite pads have been developed to combine the best characteristics of soft and hard pads. Composite polishing pads use vertical stacking or "sandwiching" of hard and soft layers in an attempt to combine the within-die control of harder pads with the within-wafer control of softer pads. However, even when such composite polishing pads are compressed by a wafer during polishing, the pad surface may still become deformed, taking on a curved shape, at the outer portion that corresponds with the edge of the wafer. This results in the degree of compression varying continuously from maximum compression to near non-compression outward from the center of the pad. Consequently, the contact pressure of the wafer applied to the polishing pad gradually decreases as the distance from the wafer center increases.

When a composite polishing pad with a relatively "hard pad" characteristic is utilized, the planarization capability can be optimized for the center regions of the wafer. However, the outer edge of the wafer (extending well beyond the 6–10 mm edge exclusion region) can witness a significantly lower amount of polishing due to the reduced polishing pad deformation at the wafer outer edge. In fact, it is very possible that within the 6–10 mm outer edge of the wafer, the polishing pad may not be contacting the wafer at all.

Likewise, when a composite polishing pad with a relatively "soft pad" characteristic is utilized, the overall planarity across the wafer is severely degraded, even though the removal amount on the outer edge of the wafer may be raised. Clearly, with the use of so-called "sandwiched" or composited polishing pads within-die planarity is at the expense of within-wafer uniformity, and vice-versa. In either case, the outer edge of the wafer suffers severely due to poor uniformity or within-die planarity resulting in an overall reduction in chip yield.

Accordingly, what is needed in the art is a semiconductor wafer polishing pad that effectively achieves both within-die and within-wafer planarity.

SUMMARY OF THE INVENTION

To address the above-discussed deficiencies of the prior art, the present invention provides a composite polishing pad. In an advantageous embodiment, the composite polishing pad includes a polishing pad member comprising a material having a predetermined hardness and an annular support member underlying a periphery of the polishing pad member, the annular support member having a hardness less than the predetermined hardness of the polishing pad member.

BRIEF DESCRIPTION OF THE DRAWINGS

For a more complete understanding of the present invention, reference is now made to the following descriptions taken in conjunction with the accompanying drawings, in which:

FIG. 2A illustrates a sectional view of a composite polishing pad manufactured according to the principles of the present invention;

FIG. 2B illustrates a top view of the polishing pad of FIG. 2A;

FIG. 3 illustrates a section view of another embodiment of a polishing pad manufactured in accordance with the present invention;

FIG. 4 illustrates a section view of yet another embodiment of a polishing pad according to the present invention;

DETAILED DESCRIPTION

Figure 1:
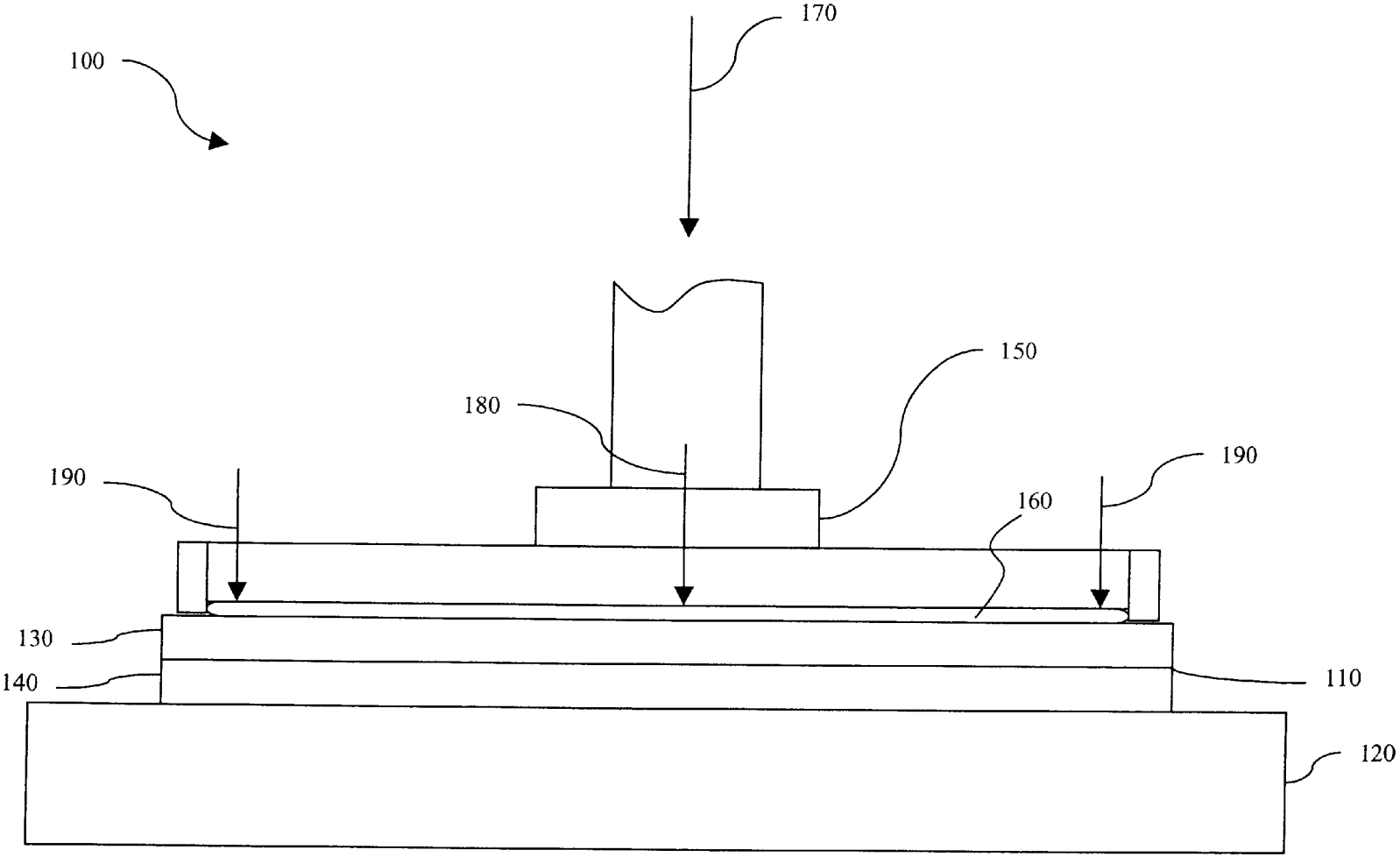
Fig. 1 (Prior Art)
FIG. 1 illustrates a CMP apparatus having a composite polishing pad found in the prior art.

Referring initially to FIG. 1, illustrated is a CMP apparatus 100 having a conventional polishing pad 110 as found in the prior art. The CMP apparatus 100 further includes a platen 120 on which the polishing pad 110 is securely mounted. The conventional polishing pad 110 is comprised of two pad layers 130, 140 joined together, usually with an adhesive. As illustrated, the upper layer 130 is formed from a polyurethane material and the lower layer 140 is formed from a foam material. As such, the upper layer 130 is much harder than the lower layer 140.

The CMP apparatus 100 further includes a carrier head 150. Mounted to the carrier head 150 is a semiconductor wafer 160 that has been selected for the CMP process. During the polishing process, a polishing force 170 is downwardly applied to the carrier head 150, causing the carrier head 150 to press the wafer 160 against the polishing pad 110, as the polishing platen 120 is rotated. The polishing force 170 results in the carrier head 150 applying a center force 180 and an edge force 190 against the wafer 160.

The center force 180 is transmitted directly beneath the polishing force 170 and is applied to the approximate center of the wafer 160. Since the center force 180 is transmitted directly beneath the polishing force 170, the center force 180 maintains substantially the same magnitude of the polishing force 170. In short, the force applied to the center of the wafer 160 during the polishing process is substantially equal to the original polishing force 170 applied to the carrier head 150.

Although the edge force 190 is also derived from the polishing force 170, the magnitudes of these forces 170, 190 are not necessarily equal. This non-uniform distribution of the polishing force 170 across the wafer 160 may cause the wafer 160 to bow when pressed against the polishing pad 110, resulting in uneven rates of film removal from the wafer 160 surface. The difference in the downforce across the wafer 160 backside causes different reaction forces at the interface between the wafer 160 and the polishing pad 110. This, in turn, results in different amounts of pad deflection across the wafer 160. Areas of the polishing pad 110 under the wafer 160 subject to higher downforce exhibit higher amounts of reaction force. These areas are also subject to greater stress and thus a different stress-strain characteristic than areas of the polishing pad 110 subject to lower downforce. The amount of pad deflection and the nature of the stress-strain relaxation curve determine the planarity performance of the polishing pad 110 at the region of contact with the wafer 160.

With such differing pad deflections, the planarity may be vary significantly across the wafer 160. As a result, regions of the wafer 160 evidencing poor planarity are sources of chip yield failure caused by a loss of focus margin at the photolithography step and occurrences of metal short-circuits or open circuits. In addition, such chip yield failure is typically observed on the dies located along the outer edge of the wafer 160. Those skilled in the art understand that the greater circumference found at the edge of the wafer 160 provides a higher chip yield than other areas of the wafer 160. The more dies along the edge of the wafer 160 excluded from use (e.g., so-called edge exclusion) the more the cost of manufacturing ICs increases. With the high cost of semiconductor wafers, edge exclusion as a result of the polishing process continues to have a serious economic impact on the manufacture of ICs.

Turning now concurrently to FIGS. 2A and 2B, FIG. 2A illustrates a sectional view of one embodiment of a composite polishing pad 200 according to the principles of the present invention. FIG. 2B illustrates a top view of the polishing pad 200 of FIG. 2A.

The polishing pad 200 includes an upper polishing pad member 210 and a lower annular support member 220. Preferably, the pad member 210 and support member 220 are held together using an adhesive, however the present invention is not so limited. For example, in an alternative embodiment, the pad member 210 and support member 220 may be created from a single piece of material.

In one aspect of the present invention, the polishing pad member 210 is comprised of a material having a predetermined hardness. The term "hardness," as used to describe the polishing pad member 210 and annular support member 220, is defined as the amount of firmness, or rigidity, or the degree of the lack of resiliency, which can directly affect the amount of compression that occurs in the material when a force is applies. Thus, the hardness of the material from which the polishing pad member 210 and the annular support member 220 is formed is inversely proportional to the compressibility of that material. For example, as the hardness of a material increases, its compressibility decreases.

In one embodiment, the polishing pad member 210 has a predetermined hardness ranging from about 40 D shore hardness to about 90 D shore hardness. In one aspect of this particular embodiment, the polishing pad member 210 may be formed with a hardness of about 60 D shore hardness to 80 D shore hardness. In this embodiment, the polishing pad member 210 is preferably formed from polyurethane material having isocyanate-based resins. Those skilled in the art are familiar with various polyurethane materials, as well as the advantages of isocyanate-based polyurethane.

In contrast, the annular support member 220 has a hardness that is less than the predetermined hardness of the polishing pad member 210. Specifically, the annular support member 220 may have a hardness ranging from about 20 A shore hardness to about 95 A shore hardness. In an advantageous embodiment, the annular support member 220 is formed with a hardness of about 40 A shore hardness to 70 A shore hardness, which is less than the hardness of the polishing pad member 210. However, like the polishing pad member 210, the annular support member 220 may be formed from a softer polyurethane than the polyurethane used to form the polishing pad member 210. Alternatively, the annular support member 220 may be formed from a foam backing material, such as commercially available Suba IV, thus having a significantly lower hardness than the polishing pad member 210.

Those skilled in the art understand that a shore hardness value of 40 D corresponds approximately to 90 A. The two hardness scales (A and D) correspond to two types of "pin indenters", namely A and D, associated with the durometer instrument used in the shore hardness test as per ASTM D2240. The A scale, using a blunt indenter, is suitable for soft material, while the D scale, using a pointed indenter, is intended for harder materials.

In the illustrated embodiment, the annular support member 220 underlies a periphery of polishing pad member 210. FIG. 2B demonstrates the annular structure of the annular support member 220 as well as its location in relation to the periphery of the polishing pad member 210. It should, of course, be understood that the present invention is not limited by any particular geometric shape or design. By underlying only a periphery of the polishing pad member 210, the harder material of the polishing pad member 210 extends into an interior opening of the annular support member 220. Thus, the polishing pad member 210 provides the entire thickness of the polishing pad 200 proximate its center, but only a portion of pad's 200 thickness at its periphery. By doing so, the polishing pad member 410 provides a uniform hardness throughout the center of the polishing pad 400, while the annular support member 420 provides a decreased hardness at it periphery. Moreover, the overall resiliency or compressibility of the periphery of the pad 200 may be altered by modifying the thicknesses of the pad member 210 and support member 220. The factors to consider when determining these sizes will be discussed later.

In one embodiment, the width of any one part of the annular support member 220 may be approximately one-third of the overall diameter of the polishing pad member 210. For example, if in the illustrated embodiment the polishing pad 200 has a twenty-four inch diameter, the annular support member 220 may occupy eight inches of the periphery around the polishing pad member 210. Alternatively, the width of the annular support member 220 may only be one-fourth the diameter of the polishing pad member 210. It must be noted, however, that the present invention is broad enough to encompass a multitude of widths for the annular support member 220, and is not limited to any particular dimension.

Further illustrated in FIG. 2A are a center force 230 and an edge force 240, similar to the downward forces 180, 190 described with respect to FIG. 1. As before, the edge force 240 is lesser in magnitude than the center force 230. However, in contrast to the reduced polishing of the edge of the wafer as occurs in the prior art, the polishing pad 200 of the present invention provides for a more uniform polishing across the entire surface of the wafer because of the difference in hardness or compressibility of the polishing pad member 210 and the annular support member 220. Since the edge force 240 provided by a carrier head is usually less than the center force 230 it provides, the polishing pad 200 of the present invention introduces a composition that provides differing corresponding reaction forces based on the hardness (and thus the compressibility) of the material at the center versus the periphery of the pad 200.

Specifically, in accordance with the present invention, the polishing pad member 210, which will typically be located beneath the downward center force 230, is comprised of a harder material as discussed above than the annular support member 220. Thus, this portion of the polishing pad 200 will provide a certain reaction force based on its compressibility and resiliency. However, the annular member 220, which will typically be located beneath the edge force 240 (e.g., the periphery), is comprised of a combination of the polishing pad member 210 and the annular support member 220. Because the support member 220 has a hardness less than that of the pad member 210, the compressibility of the peripheral portion of the polishing pad 200 is greater than the compressibility of its center. Since the compressibility is greater at its periphery than at its center, the reaction force at the periphery of the polishing pad 200 acting against the edge force 240 is less than the reaction force at the center of the polishing pad 200 acting against the center force 240.

Thus, the net result of the composition of the polishing pad 200 is to allow a semiconductor wafer to be pressed onto the polishing pad 200 during the polishing process with a different pad relaxation time for stress-strain characteristics on regions of the polishing pad 200 at the outer edge of the wafer compared to those at the center of the wafer. The enhancement of polishing pad 200 deformation along the outer edges of the wafer results in improved within-die and within-wafer control, and a reduced or eliminated edge exclusion for that wafer than that provided by prior art polishing pads.

Those skilled in the art understand that maintaining good within-die planarity helps ensure a safe focus margin for the photolithography needed to reliably print the metal patterns on the wafer dies. Also, good within-wafer planarity enables better control over the CMP process from one wafer to another, and from one lot of wafers to another, which results in a more cost efficient process. For example, a lack of edge exclusion, or even a reduction to a 3 mm edge exclusion, results in a significant increase in IC chip yield per wafer, which with the high cost of semiconductor wafers further translates into a substantial increase in revenue.

Referring now to FIG. 3, illustrated is a section view of another embodiment of a polishing pad 300 manufactured in accordance with the principles of the present invention. As with the embodiment illustrated in FIGS. 2A and 2B, the polishing pad 300 includes a polishing pad member 310 and an annular support member 320.

In accordance with the present invention, the annular support member 320 is positioned underlying a periphery of the polishing pad member 310, and has a hardness less than the predetermined hardness of the polishing pad member 310. In addition, however, the annular support member 320 now has a tapered inner edge 330. By tapering the inner edge 330 of the annular support member 320, and necessarily the corresponding edge of the polishing pad member 310, the resulting graded edge of the polishing pad 300 provides a smooth transition in hardness (and compressibility) decreasing when moving from the center of the polishing pad 300 to its peripheral edge, and vice versa.

By providing a composite polishing pad 300 having material that decreases in hardness (and increases in compressibility) when moving from the center to the edge, the reaction force provided by the polishing pad 300 decreases to correspond to the decreasing downward force encountered when moving from the center of the carrier head to its edge. In turn, the smooth transition from increased to decreased hardness when moving from the center to the periphery of the pad 300 provides for a substantially bow-free wafer during the polishing process, and superior within-die and within-wafer planarity. In addition, the deformation of the polishing pad 300 may be engineered for appropriate strain generation at varying regions of the polishing pad 300 when stress is applied onto the pad 300 and released. Different relaxation times exist at different regions across the polishing pad 300 due to the different hardness characteristics of the underlying polishing pad member 310 and the annular support member 320. Such engineering of polishing pads may result in reduced or eliminated edge exclusion, and consequently higher chip yields resulting from uniform planarity across the wafer.

Turning now to FIG. 4, illustrated is a section view of yet another embodiment of a polishing pad 400 according to the present invention. The polishing pad 400 still includes a polishing pad member 410 and an annular support member 420. In this particular aspect of the present invention, however, the polishing pad 400 now also includes a central support member 430, extending into an interior of the annular support member 420, beneath the center of the polishing pad member 410.

In this embodiment, the central support member 430 is composed of a support material having a hardness substantially equal to the hardness of the polishing pad member 410. By having a substantially equal hardness, the central support member 430 provides a support reasonably similar as that provided by the lower portion of the polishing pad member 210 occupying the interior of the annular support member 220 illustrated in FIG. 2A. As a result, the transition in hardness and compressibility from the center to the periphery of the polishing pad 400 remains substantially equal to that of the polishing pad 200 of FIG. 2A.

Since the central support member 430 provides this equivalent support to the center of the polishing pad 400, the polishing pad 400 may be manufactured by simply placing the central support member 430 into an interior of the annular support member 420 and attaching the combination to an unaltered polishing pad member 410. Specifically, this embodiment allows the polishing pad 400 to be manufactured without modifying the lower portion of the periphery of the polishing pad member 410 to accept the annular support member 420. Moreover, this embodiment still provides a variable hardness (and compressibility) when moving from the center of the polishing pad 400 to its periphery, as discussed above, as well as other advantages of the present invention that overcome the deficiencies of the prior art.

In yet another embodiment, grooved or perforated patterns, or the like, may be formed on the polishing surface of the polishing pad 400. Those skilled in the art understand that such patterns may be a circular, radial, sinusoidal, or another advantageous pattern, which enhance the distribution of the polishing slurry about the polishing pad 400. Such distribution provides for more efficient, as well as uniform, material removal during the CMP process.

Figure 5:
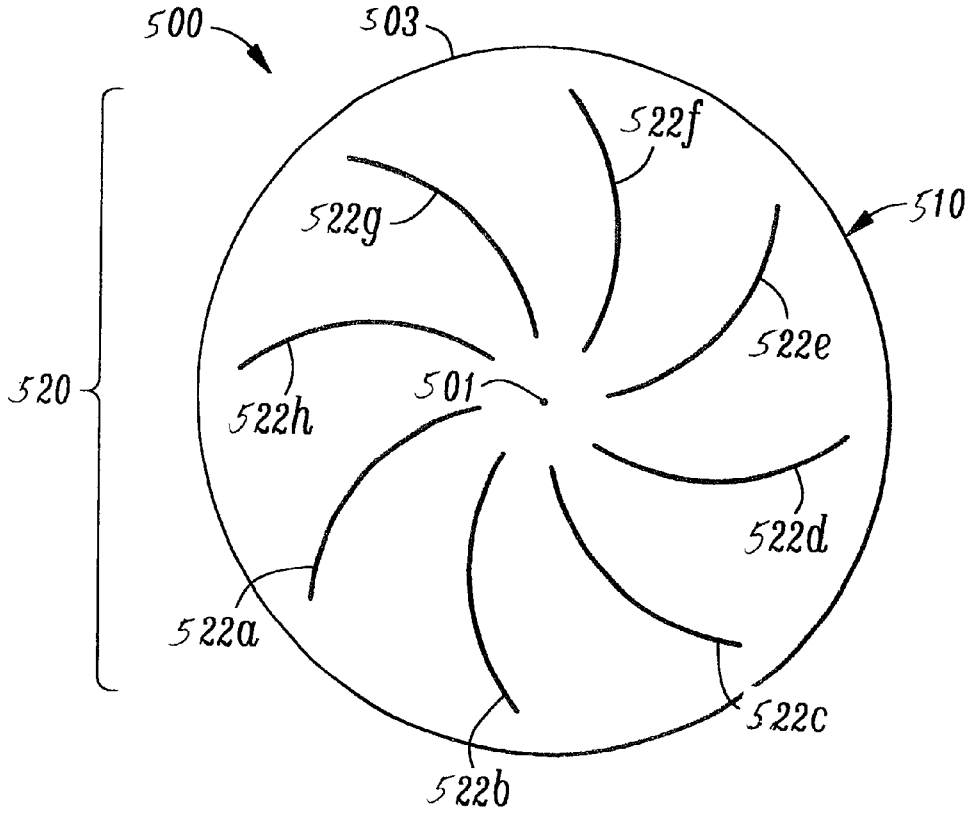
FIG. 5 illustrates an overhead view of a polishing pad having a slurry distribution incorporated into a surface thereof.

Turning to FIG. 5, illustrated is one embodiment of a slurry distribution system 520 on a polishing pad 500 manufactured according to the present invention. This slurry distribution system 520 is disclosed in co-pending patent application Ser. No. 09/357,407, entitled "Engineered Polishing Pad for Improved Slurry Distribution," commonly assigned with the present application and incorporated herein by reference in its entirety.

The polishing pad 500 includes a polishing pad member 510, with the slurry distribution system 520 formed therein. The slurry distribution system 520 is formed from the plurality of nonconcentric arcuate channels 522*a*–522*h* extending from proximate a center location 501 of the polishing pad 500 to proximate a circumference 503 of the polishing pad member 510. As slurry is deposited at about the center 501, centrifugal forces during the polishing process force the slurry out along the arcuate channels 522*a*–522*h*, thus contributing to a more even distribution of slurry across the polishing pad 500 during polishing of a semiconductor wafer while maintaining the advantages of the present invention discussed above.

Figure 6:
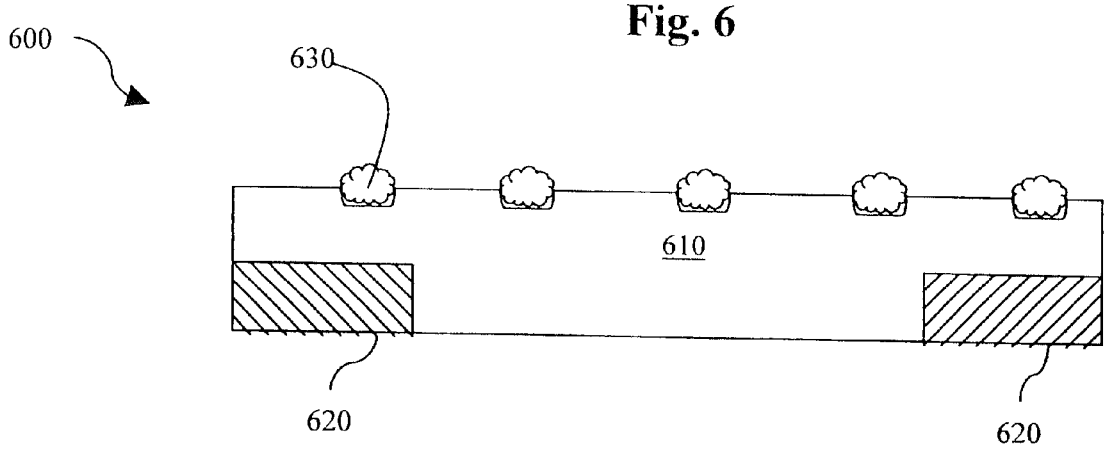
FIG. 6 illustrates a sectional view of a polishing pad manufactured according to the principles of the present invention having abrasive particles embedded therein.

Referring now to FIG. 6, illustrated is a sectional view of a polishing pad 600 manufactured according to the principles of the present invention having abrasive particles embedded therein. The polishing pad 600 includes a polishing pad member 610 and central support member 620, manufactured according to the principles described above.

In the illustrated embodiment of the present invention, abrasive material 630 may be embedded in the upper portion of the polishing pad member 610 of the polishing pad 600. In an exemplary embodiment, the abrasive material may be silica or other mineral material, however any appropriate material may be used. In such an embodiment, embedding the abrasive material 630 may eliminate the need for a polishing slurry which contains these types of abrasive particles 630, as is typically found in a conventional CMP process. Of course, even though the abrasive particles 630 are embedded in the polishing pad 600, the concepts and related advantages discussed herein regarding the present invention are applicable with this alternative embodiment.

Figure 7:
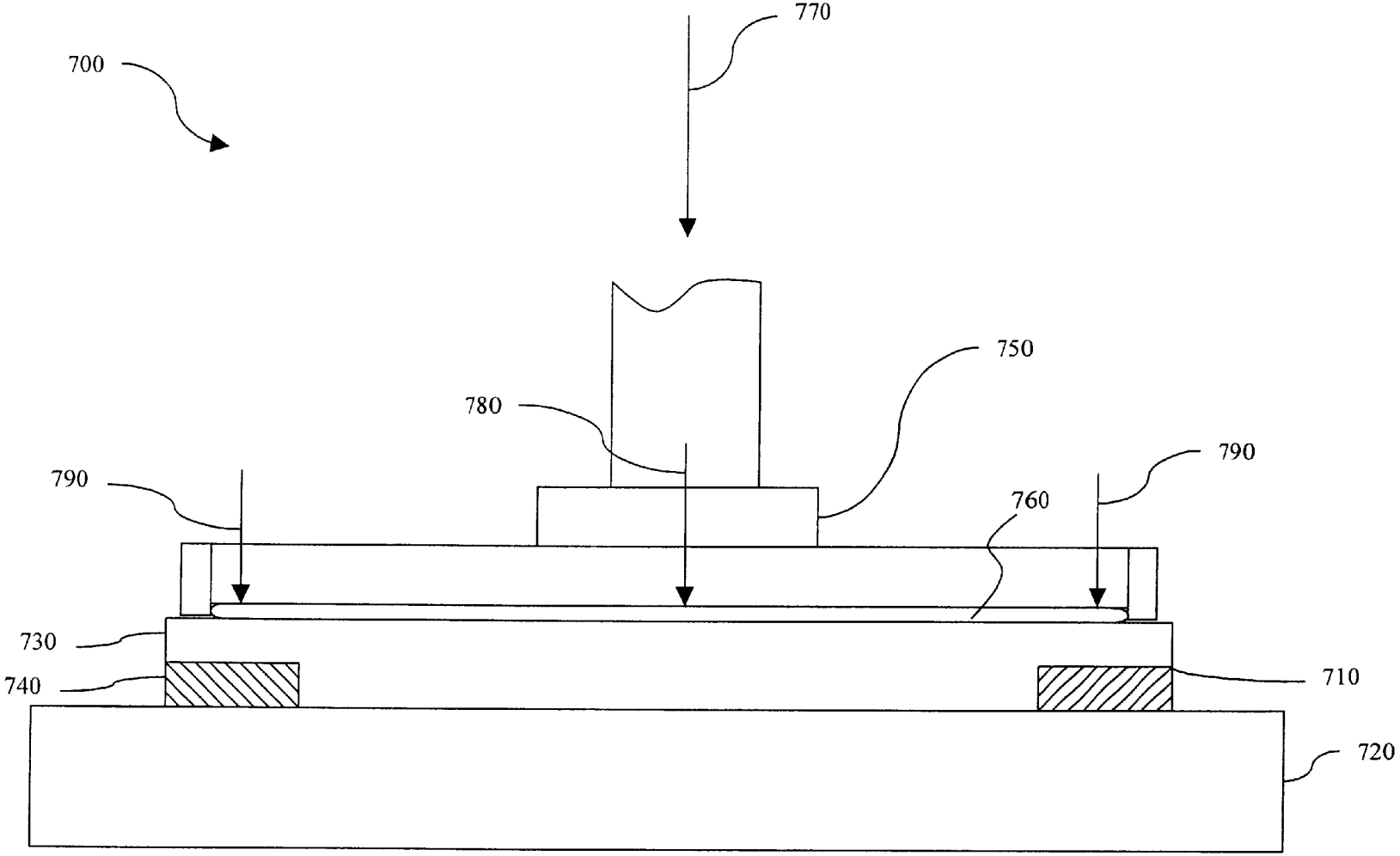
FIG. 7 illustrates a CMP apparatus employing a polishing pad manufactured in accordance with the present invention.

Now turning to FIG. 7, illustrated is a CMP apparatus 700 employing another embodiment of a polishing pad 710 manufactured in accordance with the present invention. The CMP apparatus 700 also includes a carrier head 750 that uses a down force 770 to press a wafer 760 against the polishing pad 710 during the polishing process.

The polishing pad 710 includes a polishing pad member 730 and an annular support member 740 adhesively joined to provide a composite surface for polishing the wafer 760. As before, the polishing pad 710 is securely mounted on a platen 720 so as to provide a solid platform on which to perform the CMP.

The down force 770 applied to the carrier head 750 is again transmitted into a center force 780 and an edge force 790. Because of its location in line with the down force 770, the center force 780 provides a substantially equal magnitude of down force to the center of the wafer 760. However, the edge force 790 again provides a lesser magnitude than the center force 780, for the reasons described above. Where a polishing pad found in the prior art would force the wafer 760 to bow at its center, the polishing pad 710 of the present invention provides the wafer 760 the differing zones of hardness and compressibility to keep the wafer substantially flat during the polishing process. When polished with the polishing pad 710 as provided by the present invention, the wafer 760 evidences good within-die and within-wafer control necessary for uniform planarity of the wafer's 760 surface. Of course, once a uniform planarity is achieved edge exclusion of the wafer 760 is significantly reduced or even eliminated, resulting in higher chip yields.

The determination of the extent to which the annular support member 740 should underlie the periphery of the polishing pad member 730 requires the consideration of a number of factors. Among these factors are the specific type of CMP apparatus 700 being used to perform the polishing, the rotational speed of the polishing pad 710, the size of the wafer 760, the amount of down force 770 applied to the wafer 760, and the amount of flexibility in the carrier head 750 as a result of the down force 770. For example, if the CMP apparatus 700 were designed to accommodate a twenty-four inch polishing pad 710 rather than a thirty-two inch pad, this would impact the peripheral coverage of the annular support member 740. Similarly, the size of the wafer 760 would impact how much of the periphery of the polishing pad member 730 the annular support member 740 would need to underlie. Also, the amount of down force 770 applied and the flexibility of the carrier head 750 would help determine the thickness of the annular support member 740 with respect to the thickness of the polishing pad member 730. Of course, by increasing the thickness of the annular support member 740 and decreasing the thickness of the polishing pad member 730 in the composite areas, the overall hardness of the polishing pad 710 would be decreased and its compressibility increased in those areas. These and other factors well known to those skilled in the art must be taken into account when determining both the thickness of the annular support member 740, as well as its peripheral coverage of the polishing pad member 730, to arrive at a polishing pad 710 having the characteristics to allow the wafer 760 to remain substantially flat during the polishing process.

Figure 8:
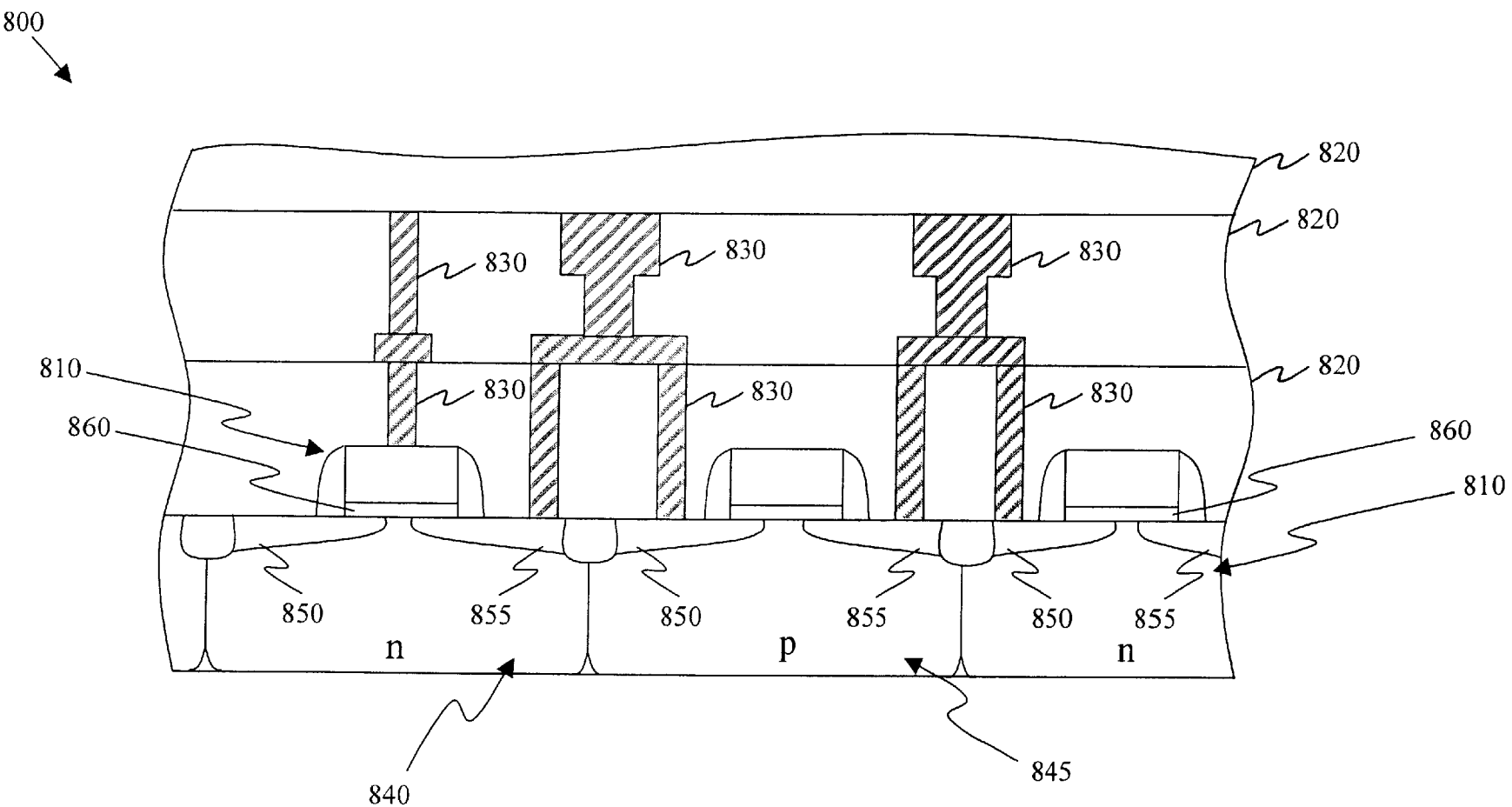
FIG. 8 illustrates a sectional view of a conventional integrated circuit that may be manufactured according to the principles of the present invention.

Turning finally to FIG. 8, illustrated is a sectional view of a conventional integrated circuit (IC) 800 that may be manufactured using the polishing pad as provided by the present invention. The IC 800 may be derived from the edge portion of a wafer after CMP with a polishing pad of the present invention.

In exemplary embodiments, the integrated circuit 800 includes interconnected active devices that form the integrated circuit 800. While, the exemplary embodiment illustrated in FIG. 8 show transistors as the active devices, it should be understood that the active devices may includes other active devices, such as resistors, capacitors, inductors, optoelectronic devices, etc. In those embodiments where the active devices are transistors, the transistors may form a CMOS device, a BiCMOS device, or a Bipolar device. Those skilled in the art are familiar with the various types of devices which may be located in the IC 800. Illustrated in FIG. 8 are components of the conventional IC 800, including: transistors 810, including the gate oxide layer 860, and dielectric layers 820, in which interconnect structures 830 are formed (together forming interconnect layers). In the embodiment shown in FIG. 8, the interconnect structures 830 connect the transistors 810 to other areas of the IC 800. Also shown in FIG. 8, are conventionally formed tubs, 840, 845, and source regions 850 and drain regions 855.

Although the present invention has been described in detail, those skilled in the art should understand that they can make various changes, substitutions and alterations herein without departing from the spirit and scope of the invention in its broadest form.

What is claimed is:

1. A composite polishing pad, comprising:

a polishing pad member comprising a material having a predetermined hardness; and an annular support member underlying a portion of the polishing pad member and having a periphery substantially coextensive with a periphery of the polishing pad member, the annular support member having a tapered inner edge and a hardness less than the predetermined hardness of the polishing pad member.

2. The composite polishing pad as recited in claim 1 wherein the polishing pad member has a hardness ranging from about 60 D shore hardness to about 80 D shore hardness and the annular support member has a hardness ranging from about 40 A shore hardness to about 70 A shore hardness.

3. The composite polishing pad as recited in claim 1 wherein the polishing pad member and the annular support member comprise polyurethane.

4. The composite polishing pad as recited in claim 3 wherein the annular support member comprises a foam backing material.

5. The composite polishing pad as recited in claim 1 wherein the polishing pad member extends into an interior opening of the annular support member.

6. The composite polishing pad as recited in claim 1 wherein the annular support member has a width ⅓ of a diameter of the polishing pad member.

7. The composite polishing pad as recited in claim 1 wherein the annular support member has a width ¼ of a diameter of the polishing pad member.

8. The composite polishing pad as recited in claim 1 wherein a support material having a hardness substantially equal to the hardness of the polishing pad member occupies an interior opening of the annular support member.

9. The composite polishing pad as recited in claim 1 wherein the polishing pad member and the annular support member comprise different materials adhesively coupled together.

10. The composite polishing pad as recited in claim 1 further including a polishing abrasive incorporated into a polishing surface of the polishing pad member.

11. The composite polishing pad as recited in claim 1 wherein the polishing pad member has a polishing pad distribution pattern formed in a surface thereof.

12. A method of manufacturing an integrated circuit having a substrate, comprising:

forming a dielectric material over the substrate; and polishing the dielectric material with a polishing pad, including:

a polishing pad member comprising a material having a predetermined hardness; and an annular support member underlying a portion of the polishing pad member and having a periphery substantially coextensive with a periphery of the polishing pad member, the annular support member having a tapered inner edge and a hardness less than the predetermined hardness of the polishing pad member.

13. The method as recited in claim 12 wherein polishing includes polishing with the polishing pad wherein the polishing pad member has a hardness ranging from about 60 D shore hardness to about 80 D shore hardness and the annular support member has a hardness ranging from about 40 A shore hardness to about 70 A shore hardness.

14. The method as recited in claim 12 wherein the polishing includes polishing with the polishing pad wherein the polishing pad member and an annular support member comprise polyurethane.

15. The method as recited in claim 12 wherein polishing includes polishing with the polishing pad wherein the polishing pad member extends into an interior opening of the annular support member.

16. The method as recited in claim 12 wherein polishing includes polishing with the polishing pad wherein the annular support member having a width ⅓ of a diameter of the polishing pad member.

17. The method as recited in claim 12 wherein polishing includes polishing with the polishing pad wherein the polishing pad includes a support material having a hardness substantially equal to the hardness of the polishing pad member that occupies an interior opening of the annular support member.

18. The method as recited in claim 12 wherein polishing includes polishing with the polishing pad wherein the polishing pad member and the annular support member comprise different materials adhesively coupled together.

* * * * *